United States Patent [19]

Lu

[11] 4,291,112

[45] Sep. 22, 1981

[54] MODIFICATION OF PIGMENT CHARGE CHARACTERISTICS

[75] Inventor: Chin H. Lu, Webster, N.Y.

[73] Assignee: Xerox Corporation, Stamford, Conn.

[21] Appl. No.: 941,539

[22] Filed: Sep. 11, 1978

[51] Int. Cl.[3] ..... G03G 9/10

[52] U.S. Cl. ..... 430/110; 427/218; 427/220; 106/308 N; 430/528; 430/115; 430/106

[58] Field of Search ..... 252/62.1; 96/150; 427/218, 220, 19; 106/308 N; 430/110, 528, 106

[56] References Cited

U.S. PATENT DOCUMENTS

| | | | |
|---|---|---|---|
| 3,427,258 | 2/1969 | Trease | 252/62.1 P |
| 3,565,654 | 2/1971 | Story | 252/62.1 P X |
| 3,749,670 | 7/1973 | Ormsbee et al. | 430/106 |
| 3,893,935 | 7/1975 | Jadwin et al. | 252/62.1 P |
| 3,960,738 | 6/1976 | O'Brien et al. | 252/62.1 P |
| 3,970,571 | 7/1976 | Olson et al. | 430/110 |
| 3,985,664 | 10/1976 | Sakaguchi et al. | 430/108 |
| 4,007,293 | 2/1977 | Mincer et al. | 96/1 SD X |
| 4,079,014 | 3/1978 | Burniss et al. | 430/110 |

FOREIGN PATENT DOCUMENTS

| | | | |
|---|---|---|---|
| 2702526 | 7/1977 | Fed. Rep. of Germany | 252/62.1 |

*Primary Examiner*—John D. Welsh

*Attorney, Agent, or Firm*—E. O. Palazzo

[57] ABSTRACT

A toner composition comprised of a resin and a pigment coated with a nitrogen containing compound thereby causing a change in the charge characteristics of the pigment, the nitrogen containing compound being selected from the group consisting of (a) quaternary ammonium compounds of the formula:

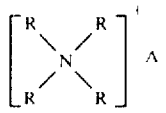

wherein R is hydrogen, hydrocarbon radicals containing from 1 to about 22 carbon atoms, or mixtures thereof, and A is an anion selected from sulfate, sulfonate, nitrate, borate, chlorate, and halogen;

(b) primary, secondary, or tertiary amines of the formula:

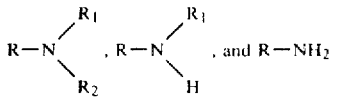

wherein R is an aliphatic radical containing from about 8 to about 22 carbon atoms, and $R_1$ and $R_2$ are hydrocarbon radicals containing from 1 to about 22 carbon atoms; and (c) an alkyl pyridinium compound, and its hydrates.

21 Claims, No Drawings

MODIFICATION OF PIGMENT CHARGE CHARACTERISTICS

BACKGROUND OF THE INVENTION

This invention is generally concerned with new developers, the use of such developers for causing the development of images in an electrophotographic system and more specifically, to the treatment of pigments used in toners primarily for providing a positive charge on such pigments.

The electrophotographic process is well known as illustrated in numerous prior art references including many patents. Generally, the process involves uniformly charging a photoconductive insulating surface which is placed on a conductive backing such as aluminum and subsequently exposing the photoconductive surface to a light image of the original to be reproduced. The photoconductive surface is prepared in such a manner so as to cause it to be conductive under the influence of the light image thus allowing the electrostatic charge form thereon to be selectively dissipated to thereby produce what is developed by means of a variety of pigmented resin materials specifically made for this purpose, such as toner. Such toner materials are electrostatically attracted to the latent image areas on the plate in proportion to the charge concentration contained thereon. Thus, for example, in areas of high charge of concentration, there is created areas of high toner density while in corresponding low charge images become proportionally less dense. The developed image can then be transferred to a final support material such as paper and fixed thereto for a permanent record or copy of the original.

Many processes are known for applying electroscopic particles or toner to the electrostatic latent image to be developed including, for example, cascade development described in U.S. Pat. No. 3,618,552, magnetic brush development described in U.S. Pat. Nos. 2,874,063, 3,251,706 and 3,357,402, powder cloud development described in U.S. Pat. No. 2,221,776 and touchdown development described in U.S. Pat. No. 3,166,432. In some instances, it may be desirable or necessary in the electrophotographic system to produce a reversed copy of the original. Thus, for example, it may be desired to produce a negative copy from a positive original or a positive copy from a negative original. Generally, this is referred to in the art as image reversal and in electrostatic printing, such image reversal can be effected by applying to the image a developer powder which is repelled by the charged areas of the image and adheres to the discharged areas. More specifically, toners containing positive charges are very useful and effective in electrophotographic reversal systems and in particular, in electrophotographic systems employing organic photoreceptors which in many instances, are initially charged negatively rather than positively, thus necessitating the need for a positively charged toner.

Reversal developers are described for example, in U.S. Pat. No. 2,986,521. Such developers comprise an electroscopic material coated with a finely divided colloidal silica. When this material is used in an electrostatic development system, the development of the electrostatic images on negatively charged surface is accomplished by applying the electroscopic material having a positive triboelectric relationship with respect to the colloidal silica. In U.S. Pat. No. 3,893,935 there is described use of certain quarternary ammonium salt as useful charge control agents for electrostatic toner compositions but not for pigments used in such compositions. According to the teachings of this patent, certain quaternary ammonium salts when incorporated into toner materials provide a particulate toner composition which exhibits relatively high uniform and stable net toner charge when mixed with a suitable carrier vehicle. This toner also exhibited a minimum amount of deleterious toner throw off. U.S. Pat. No. 4,079,014 contains a similar teaching with the exception that a different charge control agent is used namely a diazo type compound. In U.S. Pat. No. 3,749,670 electrostatic liquid developers containing carbon pigments treated with dyes having a positive charge is described.

Pigments such as carbon black, magnetite, color and other oxides, are used in a variety of products in order to impart color to these materials, and in particular, are used, for example, in toner materials for the purpose of providing color and controlling the charge on the toner by the charge contained on the pigment. Carbon black which is used as a pigment in electrophotographic toner has a rather substantial effect on the toner triboelectric properties and when used in electrophotographic ink, effects the direction and speed of pigment migration. When a carbon black material is used as a pigment, in general, in is negatively charged. Thus, when a positively charged toner employed in the development system, carbon black, which is a negative ingredient, adversely effects the developer triboelectric characteritics and the quality of the resulting image produced primarily because of the difficulty in attracting such a toner to the photoreceptor surface. Additives have been added to toners in order to cause them to charge positively, however, there is some disadvantages associated with these additives, such as additive migration, poor additive dispersion and poor toner particle-to-particle uniformity. This can cause wide distribution of electrical charge which in turn reduces the quality of the image developed and shortens the developer life.

Accordingly, there is a need for developer which contains a pigment such as carbon black which can be effectively used in a reverse system. More specifically, there is a need for a positively charged pigment which when used in a toner allows the production of high quality images over a long period of use.

SUMMARY OF THE INVENTION

It is an object of this invention to provide a pigment which overcomes the above-noted disadvantages.

It is a further object of this invention to provide a toner containing a pigment which is positively charged.

Another object of this invention is the provision of a developer which contains a toner and carrier with the toner being charged positively as a result of the coated pigment used therein.

Yet another object of this invention is the provision of developers which contain toners having rapidly fast charging rates and admixed charging behaviors.

An additional object of this invention is to provide toners which will develop electrostatic images containing negative charges on the photoreceptor surface and which will transfer effectively electrostatically from the photoreceptor to a substrate such as plain bond paper without causing blurring or adversely effecting the quality of the resulting image.

These and other objects of the present invention are accomplished by providing developers comprised of a toner resin and colorant, the colorant being treated with a nitrogen containing organic compound selected from the group consisting of quaternary ammonium salts, amines, amides, and alkyl pyridinium compounds. When using these nitrogen containing organic compounds, the type of charge as well as the magnitude of the charge on the colorant is controlled. Generally, the deposition is effected on the colorant surface by causing the physical adsorption or chemisorption of the nitrogen containing compound. After such treatment, the colorant tends to charge positively against most materials. The quaternary ammonium compounds that are useful in the present invention are of the general formula:

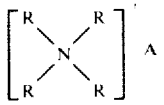

wherein R is hydrogen, hydrocarbon radicals containing from 1 to about 22 carbon atoms or mixtures thereof and A is an anion, for example, sulfate, sulfonate, nitrate, borate, chlorate, and the halogens such as iodide, chloride, and bromide.

Examples of hydrocarbon radicals include methyl, ethyl, propyl, butyl, isobutyl, tertiary butyl, pentyl, octyl, nonyl, pentadecanyl, ethylene, propylene, butylene, pentene, hexene, nonene, benzyl, and the like.

Illustrative examples of preferred quaternary ammonium compounds utilized in the practice of the present invention include tetraethyl ammonium bromide, tetrabutyl ammonium chloride, distearyl dimethyl ammonium chloride, cetyl dimethyl benzyl ammonium chloride, cetyl dimethyl benzyl ammonium bromide, dimyristyl methyl benzyl ammonium chloride, and the like.

Several methods may be employed to produce the toner of the present invention, one typical method involving melt-blending the resin and the pigment coated with a quaternary ammonium compound, followed by mechanical attrition. Other methods include those known in the art such as spray drying, melt dispersion and dispersion polymerization. For example, a solvent dispersion of resin, pigment, treated or coated with a quaternary ammonium compound are spray dryed under controlled conditions thereby resulting in the desired product.

Numerous amines can be used for treating the pigments of the present invention, such amines including primary, secondary and tertiary amines of the following formulas:

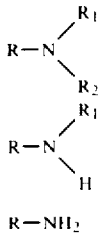

wherein R is an aliphatic radical containing from about 8 to about 22 carbon atoms, $R_1$ and $R_2$ are hydrocarbon radicals containing from 1 to 22 carbon atoms including for example, methyl, ethyl, propyl, butyl, isobutyl, tertiary butyl, pentyl, octyl, nonyl, pentadecanyl, benzyl and the like.

Examples of some specific amines embraced within the aboveidentified formulas include dodecylamine, octadecyl amine, di(hydrogenatedtallow)amine, dimethyl octadecyl amine, oleyl-1,3-diaminopropane, tallow-1,3-diaminopropane, tetraethylene pentamine, alkyl substituted imidazoline, alkyl substituted oxazoline.

Also useful for treating the colorants of the present invention are the alkyl pyridinium compounds as described in copending application U.S. Ser. No. 911,623, filed on June 1, 1978 on Toners Containing Alkyl Pyridinium Compounds and Their Hydrates toners containing alkyl pyridinium compounds and their hydrates, the entire disclosure contained in such application being totally incorporated herein by reference. These compounds and their hydrates are represented by the following formula:

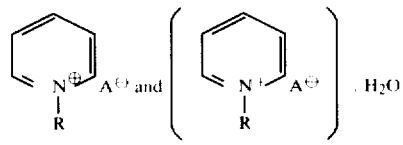

wherein A is an anion selected from halides such as chlorine, bromine, iodine, sulfate, sulfonate, nitrate and borate, and R is a hydrocarbon radical containing from about 8 to about 22 carbon atoms and preferably from 12 to 18 carbon atoms. Illustrative examples of some of the alkyl pyridinium compounds that may be useful include for example cetyl pyridinium chloride, heptadecyl pyridinium bromide, octadecyl pyridinium chloride, myristyl pyridinium chloride and the like as well as their corresponding hydrates.

Generally, the method of treatment involved dissolving in an appropriate solvent such as water, alcohol, or a water alcohol mixture and the like about 0.1 to 40 parts of nitrogen containing organic compound with about 100 parts of the pigment being added to the solution with vigorous stirring. After about 20 minutes to about 2 hours of such stirring, the mixture is filtered and the resulting filter cake is thoroughly washed with solvent and dried at room temperature or at a slightly elevated temperature above 50° C. The clumps eventually obtained after drying are broken up by grinding or similar methods and the resulting pigment in powder form is then suitable for use in a toner and other applications.

Various pigments that can be treated in accordance with the present invention include both inorganic and organic materials such as carbon black, magnetite, colored iron oxides, titanium dioxide, zinc oxide, chromium oxide, Prussian Blue, phthalocyanines, and the like. Many types of carbon black are useful including furnace carbon blacks and channel carbon blacks commercialy available from many sources such as Cabat Corporation including, for example, carbon black such as Vulcan XC-72R, Vulcan 6, Black Pearls L, Monarch 1300, Mogul L, Raven 420, Regal 330 and the like.

The pigment should be present in the toner and in sufficient quantity to render it highly colored so that it will form a clearly visible image on the recording member. For example, where conventional xerographic copies of documents are desired, the toner may comprise a black pigment such as carbon black or magnetite.

The amount of nitrogen containing compound used can vary over wide range as long as it does not adversely effect the system, but generally ranges from about 1 to about 50 parts per weight per 100 parts per weight of pigment and preferably from about 5 to about 20 parts per weight to about 100 part per weight of pigment. Of course, the amount of nitrogen-containing compound used would depend on the particular pigment being treated. Thus, for example, when carbon black is being treated, generally from about 5 parts to about 20 parts per weight of nitrogen-containing compound is used per 100 parts per weight of carbon black.

When used in a toner composition, the amounts of pigment with nitrogen containing compound employed will vary depending on the particular pigment employed, but generally the amount of pigment to toner ranges from about 1 part to about 50 parts and preferably from about 5 parts by about 20 parts.

In a preferred embodiment, when carbon black is used as the pigment and the nitrogen containing compound is an alkyl pyridinium compound such as cetyl pyridinium chloride, the ratio of carbon black to toner is about 5 to 10 percent.

While any suitable resin may be employed as the toner for the present invention, typical of such resins include polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl napthalene, ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene, aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, nonvinyl type thermoplastic resins may also be employed including resin modified phenol-formaldehyde resins, oil modified epoxy resins, polyurethane resins, cellulosic resins, polyether resins and mixtures thereof.

Also esterification products of a dicarboxylic acid and a diol comprising a diphenol may be used as a preferred resin for the toner composition of the present invention. These materials are illustrated in U.S. Pat. No. 3,655,374 totally incorporated herein by reference, the diphenol reactant being of the formula as shown in Column 4, beginning at line 5 of this patent and the dicarboxylic acid being of the formula as shown in Column 6 of the above patent. The resin is present in an amount so that the total of all ingredients used in the toner total about 100%, thus when 5% by weight of the alkyl pyridinium compound is used and 10% by weight of pigment such as carbon black, about 85% by weight of resin material is used.

Optimum electrophotographic resins are achieved with styrene butylmethacrylate, copolymers, styrene vinyl toluene copolymers, styrene acrylate copolymers, polyester resins, predominantly styrene or polystyrene base resins as generally described in U.S. Pat. No. Re. 25,136 to Carlson and polystyrene blends as described in U.S. Pat. No. 2,788,288 to Rheinfrank and Jones.

Any suitable carrier material can be employed as long as such particles are capable of triboelectrically obtaining a charge of opposite polarity to that of the toner particles. In the present invention in one embodiment that would be a negative polarity, to that of the toner particles which are positively charged so that the toner particles will adhere to and surround the carrier particles. Thus, the carriers can be selected so that the toner particles acquire a charge of a positive polarity and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like. The carriers can be used with or without a coating. Many of the typical carries that can be used are described in U.S. Pat. Nos. 2,618,441; 2,638,416; 2,618,522; 3,591,503; 3,533,835; and 3,526,533. Also, nickel berry carriers are described in U.S. Pat. Nos. 3,847,604 and 3,767,598 can be employed, these carriers being modular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier may be employed with the toner composition in any suitable combination, however, best results are obtained when about 1 part per toner is used and about 10 to about 200 parts by weight of carrier.

Toner compositions of the present invention may be used to develop electrostatic latent images on any suitable electrostatic surface capable of retaining charge including conventional photoconductors, however, the toners of the present invention are best utilized in systems wherein a negative charge resides on the photoreceptor and this usually occurs with organic photoreceptors, illustrative examples of such photoreceptors being polyvinyl carbazole, 4-dimethylaminobenzylidene, benzhydrazide; 2-benzylidene-amino-carbazole, 4-dimethylamino-benzylidene, benzhydrazide; 2-benzylidene-aminocarbazole, polyvinyl carbazole (2-nitro-benzylidene)-p-bromoaniline; 2,4-diphenyl-quinazoline; 1,2,4-triazine; 1,5-diphenyl-3-benzoxazole; 3-amino-carbazole; polyvinylcarbazole-tritrofluorenone charge transfer complex; phthalocyanines and mixtures thereof.

The following examples are being supplied to further define the species of the present invention being noted that these examples are intended to illustrate and not limit the scope of the present invention. Parts and percentages are by weight unless otherwise indicated.

EXAMPLE I

Three carbon blacks Mogul L, Regal 330 both commercially available from Cabot Corporation and Raven 420 commercially available from City Services Company were treated with various nitrogen containing compounds as follows: Five (5) to 10 parts of nitrogen-containing organic compound was dissolved in a solvent mixture containing 50 percent isopropyl alcohol and 50 percent (by volume) water. 100 parts of carbon black was added to the solution and the mixture was vigorously stirred for a time period under 2 hours. The mixture was then filtered. The filter cake was washed with the solvent mixture and dried. The clumps obtained were broken up to powder by mechanical attrition.

The treated carbon black was measured for charge characteristics by the floating potential technique, where the treated carbon black was placed on an electrode connected to a potentiometer. Another electrode which was gold-plated was placed in contact with the treated carbon black. The potential, in volts, of the treated carbon black with reference to gold was recorded and taken as a measure of the charge characteristics. The floating potentials of these carbon blacks before and after treatment were measured. The potentials in volts with reference to gold are given in Table I.

As shown in Table I prior to treatment with the nitrogen containing compound, the carbon black showed negative or low positive floating potential. However, subsequent treatment with a nitrogen containing compound listed, the floating potential showed dramatic increases in positive values.

TABLE I

| Carbon Black | Treatment | Amount, per 100 Parts Carbon Black | Floating Potential Volts |
|---|---|---|---|
| Mogul L | None | 0 | −2.5 |
| Mogul L | 1-hydroxyethyl,2-heptadecyl imidazoline | 10 | +.53 |
| Raven 420 | None | 0 | +.16 |
| Raven 420 | alkyl (containing 12 to 22 carbon atoms) substituted imidazoline | 5 | +.38 |
| Regal 330 | None | 0 | +.15 |
| Regal 330 | alkyl (containing 12 to 22 carbon atoms) substituted imidazoline | 5 | +.31 |
| Regal 330 | quaternized alkyl substituted imidazoline | 10 | +.41 |
| Regal 330 | distearyl dimethyl ammonium chloride | 5 | +.39 |
| Regal 330 | tetraethylene pentamine | 10 | +.38 |
| Regal 330 | 1-hydroxyethyl,2-heptadecyl imidazoline | 10 | +.53 |
| Regal 330 | tetrabutyl ammonium chloride | 10 | +.47 |
| Regal 330 | N-tallow-1,3-diaminopropane | 10 | +.40 |
| Regal 330 | cetyl pyridinium chloride | 10 | +.38 |
| Regal 330 | alkyl (containing 12 to 22 carbon atoms) dimethyl benzyl ammonium chloride | 10 | +.51 |

EXAMPLE II

Three toners of the following composition were prepared by melt blending followed by mechanical attrition. Toner A - 10% Mogul L 90% styrene/n-butyl methacrylate (65/35) copolymer resin. Toner B - 10% Mogul L, 0.5% of alkyl substituted imidazoline coated on carbon black, 89.5% styrene/n-butyl methacrylate (65/35) copolymer resin. Toner C - 10% Mogul L, 0.5% of distearyl dimethyl ammonium chloride coated on carbon black, 89.5% styrene/n-butyl methacrylate (65/35) copolymer resin.

Three (3) parts of toner and 100 parts of a Hoeganaes steel carrier coated with 0.2% Kynar 201 (polyvinylidene fluoride resin available from Pennwalt Corporation) were blended into a developer. The developer was roll mixed at a linear speed of 90 feet per minute.

After 60 minutes, the tribo electric charges of these toners against the carrier were measured with the following results:

| Toner | Toner Tribo (Microcoulombs per gram) |
|---|---|
| A (control) | +1 |
| B | +17 |
| C | +26 |

Toner B and C which were comprised of a carbon black treated with a nitrogen containing compound of the present invention had significantly higher triboelectric charge than toner A, the control which was comprised of untreated carbon black.

EXAMPLE III

Three toners of the following compositions were prepared by melt blending following by mechanical attrition. Toner D - 10% Regal 330, 90% styrene/n-butyl methacrylate (65/35) copolymer resin. Toner E - 10% Regal 330, 0.8% of N-tallow-1,3-dianiopropane dioleate coated on carbon black and 89.2% styrene/n-butyl methacrylate (65/35) copolymer resin. Toner F - Regal 330, 1.5% of N-tallow-1,3-diaminopropane dioleate coated on carbon black and 88.5% styrene/n-butyl methacrylate (65/35) copolymer resin.

After 60 minutes of roll mixing the tribos of these three toners were measured against a 0.2% Kynar 201 (polyvinylidene fluoride resin available from Pennwalt Corporation) coated hoeganaes carrier with the following results:

| Toner | Toner Tribo (Microcoulombs per gram) |
|---|---|
| D (control) | +9 |
| E | +15 |
| F | +20 |

Toners E and F which were comprised of carbon black treated with the nitrogen containing compounds of the present invention had significantly higher triboelectric charge than toner D which was comprised of untreated carbon black.

EXAMPLE IV

The procedure of Example II was repeated with the exception that different toner materials were used as indicated below:

Toner G 6% Regal 330, 20% Acryloid DM54 which is a copolymer containing isobornyl methacrylate available from Rohm and Haas Co., 74% sytrene/n-butyl methacrylate 65/35 copolymer resin. Toner I - 6% Regal 330 treated with tetrabutylammonium chloride, 20% Acryloid DM54 and 74% of styrene/n-butyl methacrylate 65/35 copolymer resin. Toner J - 6% of Regal 330 treated with quaternized alkyl substituted imidazoline, 20% Acryloid DM54 and 74% of styrene/n-butyl methacrylate 65/35 copolymer resin.

After 60 minutes of roll mixing the tribo of these toners were measured against a 0.35% perfluoro alkoxy fluoropolymer commercially available from the duPont Company, coated Hoeganaes steel carrier with the following results:

| Toner | Toner Tribo (Microcoulombs per gram) |
|---|---|
| G (control) | +25 |
| I | +36 |
| J | +39 |

The triboelectric charges of toners I and J prepared with treated carbon black increased substantially over that of toner G prepared with untreated carbon black.

EXAMPLE V

This example demonstrates the use of treated carbon black in a toner which is used for developing electrostatic latent images resulting in images of high quality and good resolution as well as good transfer. Toner K comprising 8% Regal 330 carbon black, 0.8% cetyl pyridinium chloride coated on the carbon black, and 91.2% of styrene/n butyl methacrylate copolymer resin (65/35) was prepared by melt blending followed by mechanical attrition. The toner was classified to remove particles having diameters below about 5 microns and 3 parts of the classified toner together with 100 parts of 0.4% of Kynar 201 vinylidene fluoride resin coated on atomized steel carrier were blended into a developer. The developer was tested in a fixture using a photoreceptor charged negatively and produced prints of excellent quality.

Other modifications of the present invention will occur to those skilled in the art upon a reading of the present disclosure. These are intended to be included within the scope of this invention.

What is claimed is:

1. A positively charged dry electrophotographic developer composition comprised of a resin, a carrier, and as a pigment carbon black precoated with a nitrogen containing compound, the nitrogen containing compound being selected from the group consisting of (a) quaternary ammonium compounds of the formula:

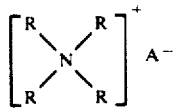

wherein R is hydrogen, hydrocarbon radicals containing from 1 to about 22 carbon atoms, or mixtures thereof, and A is an anion selected from sulfate, sulfonate, nitrate, borate, chlorate, and halogen;

(b) primary, secondary, or tertiary amines of the formula:

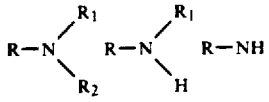

wherein R is an aliphatic radical containing from about 8 to about 22 carbon atoms, and $R_1$ and $R_2$ are hydrocarbon radicals containing from 1 to about 22 carbon atoms; and (c) an alkyl pyridinium compound, whereby the coated carbon black pigment is positively charged.

2. A developer composition in accordance with claim 1 wherein the hydrocarbon radical on the quaternary ammonium compound is methyl, ethyl, propyl, butyl, isobutyl, tertiary butyl, pentyl, ethylene, propylene, butylene or hexene.

3. A developer composition in accordance with claim 1 wherein the amine compound is of the formula:

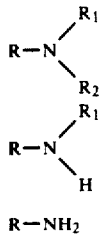

wherein R is an aliphatic radical containing from about 8 to about 22 carbon atoms, $R_1$ and $R_2$ are hydrocarbon radicals containing from 1 to 22 carbon atoms.

4. A developer composition in accordance with claim 1 wherein the quaternary ammonium compound is tetraethyl ammonium bromide.

5. A developer composition in accordance with claim 1 wherein the quaternary ammonium compound is tetrabutyl ammonium chloride.

6. A developer composition in accordance with claim 1 wherein the quaternary ammonium compound is stearyl dimethyl benzyl ammonium bromide.

7. A developer composition in accordance with claim 1 wherein the alkyl pyridinium compound is cetyl pyridinium chloride.

8. A developer composition in accordance with claim 1 wherein the carrier is selected from perfluoroalkoxy fluoropolymer coated steel carrier or a vinylidene fluoride resin coated steel carrier.

9. A method of imaging comprising forming an electrostatic latent image on a photoreceptor contacting the image with the compositions of claim 1 and subsequently transferring the developed image to a permanent substrate and permanently affixing the image thereto.

10. A method in accordance with claim 9 wherein the hydrocarbon radical on the quaternary ammonium compound is methyl, ethyl, propyl, butyl, isobutyl, tertiary butyl, pentyl, ethylene, propylene, butylene or hexene.

11. A method in accordance with claim 9 wherein the amine compound is of the formula:

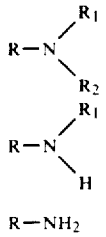

wherein R is an aliphatic radical containing from about 8 to about 22 carbon atoms, $R_1$ and $R_2$ are hydrocarbon radicals containing from 1 to 22 carbon atoms.

12. A method in accordance with claim 9 wherein the quaternary ammonium compound is tetrabutyl ammonium chloride.

13. A method in accordance with claim 9 wherein the quaternary ammonium compound is stearyl dimethyl benzyl ammonium bromide.

14. A method in accordance with claim 9 wherein the alkyl pyridinium compound is cetyl pyridinium chloride.

15. A method in accordance with claim 9 wherein the carrier is selected from perfluoroalkoxy fluoropolymer coated steel carrier or a vinylidene fluoride resin coated steel carrier.

16. A developer composition in accordance with claim 1 wherein the alkyl pyridinium compound is of the formula:

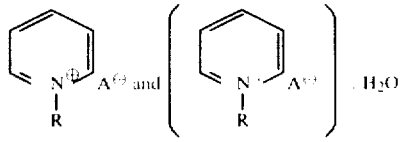

wherein R is a hydrocarbon radical containing from about 8 to about 22 carbon atoms and A is an anion selected from halides, bromine, iodine, sulfate, sulfonate, nitrate and borate.

17. A method in accordance with claim 9 wherein the alkyl pyridium compound is of the formula

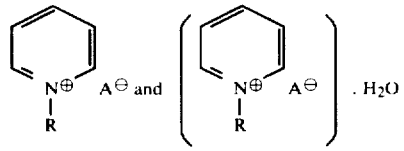

wherein R is a hydrocarbon radical containing from about 8 to about 22 carbon atoms and A is an anion selected from halides, bromine, iodine, sulfate, sulfonate, nitrate and borate.

18. A developer composition in accordance with claim 1 wherein the amount of nitrogen containing compound ranges from about 1 part to about 50 parts per weight per 100 parts per weight of pigment.

19. A developer composition in accordance with claim 1 wherein the amount of nitrogen containing compound ranges from about 5 to about 20 parts per weight to about 100 parts per weight of pigment.

20. A positively charged dry electrophotographic developer composition comprised of a resin, a carrier, and as a pigment, carbon black coated with an alkyl substituted imidazoline.

21. A method of imaging comprising forming an electrostatic latent image on a photoreceptor, contacting the image with the developer composition of claim 20, and subsequently transferring the developed image to a permanent substrate, and permanently affixing the image thereto.

* * * * *